US008015645B2

(12) United States Patent
Park et al.

(10) Patent No.: US 8,015,645 B2
(45) **Date of Patent: *Sep. 13, 2011**

(54) WASHING MACHINE AND A METHOD OF CONTROLLING THE SAME BASED ON MEASURED HARDNESS OF WATER

(75) Inventors: Seok Kyu Park, Changwon-si (KR); Seog Ho Go, Chagwon-si (KR); Bo Sun Chung, Pusan (KR); Young Soo Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 920 days.

This patent is subject to a terminal disclaimer.

(21) Appl. No.: 10/558,188

(22) PCT Filed: May 28, 2004

(86) PCT No.: PCT/KR2004/001256

§ 371 (c)(1),
(2), (4) Date: Jan. 16, 2007

(87) PCT Pub. No.: WO2004/106616

PCT Pub. Date: Dec. 9, 2004

(65) Prior Publication Data

US 2008/0000272 A1 Jan. 3, 2008

(30) Foreign Application Priority Data

May 28, 2003 (KR) ..... 10-2003-0034002
Jun. 23, 2003 (KR) ..... 10-2003-0040673
Aug. 7, 2003 (KR) ..... 10-2003-0054634

(51) Int. Cl.
*D06F 35/00* (2006.01)
*D06F 33/00* (2006.01)

(52) U.S. Cl. ..... 8/158; 68/12.02

(58) Field of Classification Search ..... 8/158; 68/12.02
See application file for complete search history.

(56) References Cited

U.S. PATENT DOCUMENTS 3,393,970 A * 7/1968 Martz, Jr. ..... 8/137
3,645,669 A * 2/1972 Rausch ..... 8/137
5,419,163 A 5/1995 Kim et al. ..... 68/12.02

(Continued)

FOREIGN PATENT DOCUMENTS

CN 1548608 A * 11/2004

(Continued)

OTHER PUBLICATIONS

Chinese Office Action dated Mar. 6, 2009.

(Continued)

*Primary Examiner* — Frankie L Stinson
*Assistant Examiner* — Charles W King
(74) *Attorney, Agent, or Firm* — KED & Associates, LLP

(57) ABSTRACT

A method for controlling a washing machine is provided. The method includes setting a washing pattern in a present operation of the washing machine in consideration of a hardness of water calculated in a previous operation of the washing machine, operating the washing machine based on the set washing pattern, and calculating and storing a hardness of the water in the present operation of the washing machine to set a next washing pattern in the next operation of the washing machine, thereby having the optimum washing or rinsing capacity of the washing machine in consideration of different characteristics of water by regional groups.

25 Claims, 14 Drawing Sheets

U.S. PATENT DOCUMENTS

| | | | | |
|---|---|---|---|---|
| 5,694,793 | A | 12/1997 | Nishimura et al. | 68/12.27 |
| 6,766,812 | B1 * | 7/2004 | Gadini | 134/56 D |
| 6,958,693 | B2 * | 10/2005 | Rothgeb et al. | 340/539.22 |
| 2001/0049846 | A1 * | 12/2001 | Guzzi et al. | 8/158 |
| 2002/0142935 | A1 * | 10/2002 | Oubrahim et al. | 510/439 |
| 2003/0106164 | A1 * | 6/2003 | Metzger-Groom et al. | 8/158 |
| 2005/0081572 | A1 * | 4/2005 | Park et al. | 68/12.02 |

FOREIGN PATENT DOCUMENTS

| | | | | |
|---|---|---|---|---|
| DE | 2854148 | A | * | 6/1979 |
| DE | 195 41 719 | A1 | | 5/1997 |
| EP | 0 051 491 | A1 | | 5/1982 |
| EP | 0 331 149 | A2 | | 9/1989 |
| EP | 0 619 395 | A1 | | 10/1994 |
| EP | 0 633 342 | A1 | | 1/1995 |
| GB | 1062774 | | | 5/1967 |
| GB | 2 051 413 | A | | 1/1981 |
| GB | 2 052 251 | A | | 1/1981 |
| GB | 2 266 898 | A | | 11/1993 |
| JP | 3-106393 | | | 5/1991 |
| JP | 6-79086 | | | 3/1994 |
| JP | 06-233892 | A | | 8/1994 |
| JP | 07-059978 | | | 3/1995 |
| JP | 2000-014982 | | | 1/2000 |
| JP | 2001-017775 | | | 1/2001 |
| JP | 2002-166092 | | | 6/2002 |
| KR | 10-1995-0007066 | | | 6/1995 |
| KR | 10-0191526 | B1 | | 1/1999 |
| KR | 10-2000-0032576 | A | | 6/2000 |
| KR | 10-2001-0054769 | A | | 7/2001 |
| WO | WO 95/12704 | | | 5/1995 |

OTHER PUBLICATIONS

International Search Report.

European Search Report dated Mar. 9, 2010 for Application No. 04 735 412.1.

European Search Report date Jan. 21, 2009.

International Search Report, Aug. 19, 2004.

* cited by examiner

WASHING MACHINE AND A METHOD OF CONTROLLING THE SAME BASED ON MEASURED HARDNESS OF WATER

TECHNICAL FIELD

The present invention relates to a control method of a washing machine, and more particularly to a control method of a washing machine, in which a washing operation is performed based on the optimum washing pattern in consideration of the hardness of water supplied to the washing machine.

BACKGROUND ART

Generally, a washing machine is an apparatus providing a mechanical action using electricity, thereby removing dirt from clothes. When the clothes are put into water containing a detergent dissolved therein, dirt is removed from the clothes by a chemical action of the detergent. However, since it takes a long time to remove the dirt from the clothes by the chemical action of the detergent alone, the dirt can be easily removed from the clothes by forcibly generating a rotary current or applying a mechanical action such as friction or vibration to the clothes.

The washing machine comprises an outer tub, an inner tub rotatably placed in the outer tub for containing clothes, a wash vane rotatably installed in the inner tub for generating a washing current, and a motor and a clutch installed below the lower part of the outer tub for rotating the inner tub or the wash vane.

The above washing machine has different washing and rinsing capacities according to the quantity of the clothes, the quantity of the detergent, and the hardness of wash water. In a conventional control method of the washing machine, the quantity of the clothes putted into the inner tub is sensed, a washing pattern including washing time, rinsing frequency, rinsing time, dehydrating time, etc. is set based on the sensed quantity of the clothes, and the washing machine is operated according to the set washing pattern.

However, the conventional control method of the washing machine considers only the quantity of the clothes while disregarding the hardness of the water supplied to the washing machine, thus causing a limit in improving washing or rinsing capacity of the washing machine.

DISCLOSURE OF THE INVENTION

Therefore, the present invention has been made in view of the above problems, and it is an object of the present invention to provide a control method of a washing machine, in which a washing pattern is determined in consideration of characteristics of supplied water, thereby improving washing or rinsing capacity.

In accordance with one aspect of the present invention, the above and other objects can be accomplished by the provision of a control method of a washing machine comprising the steps of: (a) setting a present washing pattern in consideration of the hardness of the water calculated and stored in the previous operation of the washing machine; (b) operating the washing machine based on the set present washing pattern; and (c) calculating and storing the hardness of the water in the present operation of the washing machine for setting a next washing pattern for the next operation of the washing machine.

Preferably, the hardness of the water stored in the previous operation of the washing machine may be automatically loaded when power is inputted to the washing machine.

Further, preferably, the hardness of the water in the present operation of the washing machine may be calculated after water in the washing machine is agitated for a predetermined time or more.

Moreover, preferably, step (c) may include the sub-steps of: (c-1) measuring temperature and conductivity of the water; and (c-2) calculating the hardness of the water based on the temperature and conductivity of the water measured in sub-step (c-1).

Preferably, sub-step (c-1) may be performed a predetermined time before a final rinsing operation is completed.

Further, preferably, the washing pattern may include at least one of washing intensity, supplied water level, washing time, rinsing frequency, rinsing time, and dehydrating time.

Moreover, preferably, in step (a), in case that the washing machine is in an initial operation, the washing pattern may be set based on an already-inputted standard hardness of the water.

Preferably, in step (c), in case that the washing machine is operated plural times, the cumulative mean of the hardnesses of water in the plural operations of the washing machine may be calculated and stored.

Further, preferably, in step (c), in case that the washing machine is operated four times or more, the cumulative mean of the hardnesses of water in the plural operations of the washing machine except for the maximum and minimum hardnesses of water may be calculated and stored.

Moreover, preferably, in step (c), in case that the washing machine is operated times corresponding to a predetermined frequency or more, the running mean of the hardnesses of water in the plural operations of the washing machine may be calculated and stored.

Preferably, the set present washing pattern may be displayed so that it is recognized by users.

In accordance with another aspect of the present invention, there is provided a control method of a washing machine comprising the steps of: (I) sensing the quantity of clothes after instructions for operating the washing machine are inputted to the washing machine, and setting a washing pattern based on the sensed quantity of clothes; (II) supplying water based on the washing pattern set in step (I), and dissolving a detergent in the water; (III) measuring conductivity and temperature of the water containing the detergent, calculating the quantity of the detergent in consideration of the hardness of the water calculated and stored in the previous operation of the washing machine, and resetting the washing patter based on the calculated quantity of the detergent; and (IV) performing a washing or rinsing operation based on the reset washing pattern and calculating and storing the hardness of the water in a final rinsing operation.

In accordance with yet another aspect of the present invention, there is provided a control method of a washing machine comprising the steps of: (I) setting a washing pattern based on the hardness of the water calculated and stored in the previous operation of the washing machine after instructions for operating the washing machine are inputted to the washing machine; (II) supplying water based on the washing pattern set in step (I), and dissolving a detergent in the water; (III) measuring conductivity and temperature of the water containing the detergent, calculating the quantity of the detergent in consideration of the hardness of the water calculated and stored in the previous operation of the washing machine, and resetting the washing pattern based on the calculated quantity of the detergent; and (IV) performing a washing or rinsing operation based on the reset washing pattern, and calculating and storing the hardness of the water in a final rinsing operation.

Preferably, in step (I), washing, rinsing and dehydrating times of the set washing pattern may be displayed so that they are recognized by users.

Further, preferably, in step (III), the conductivity and temperature of the water containing the detergent dissolved therein may be displayed to the outside through a sensor operation display so that they are recognized by users during the measurement thereof.

Moreover, preferably, in step (III), one table may be selected from a plurality of tables containing quantities of the detergent according to hardnesses of water, and the quantity of the detergent corresponding to the conductivity and temperature of the water containing the detergent dissolved therein may be calculated from the selected table.

Preferably, in step (III), in case that the washing machine is in an initial operation, the washing pattern may be set based on an already-inputted standard hardness of the water.

Further, preferably, step (IV) may include the sub-steps of: (i) measuring temperature and conductivity of the water in a final rinsing operation; and (ii) calculating the hardness of the water based on the temperature and conductivity of the water measured in sub-step (i).

More preferably, sub-step (i) may be performed after water in the washing machine is agitated for a predetermined time or more.

Alternately, sub-step (i) may be performed a predetermined time before a final rinsing operation is completed.

Moreover, preferably, in step (IV), residual washing, rinsing and dehydrating times changed by the reset washing pattern may be displayed.

Preferably, in step (IV), in case that the washing machine is operated plural times, the cumulative mean of the hardnesses of water in the plural operations of the washing machine may be calculated and stored.

Further, preferably, in step (c), in case that the washing machine is operated four times or more, the cumulative mean of the hardnesses of water in the plural operations of the washing machine except for the maximum and minimum hardnesses of water may be calculated and stored.

Moreover, preferably, in step (c), in case that the washing machine is operated times corresponding to a predetermined frequency or more, the running mean of the hardnesses of water in the plural operations of the washing machine may be calculated and stored.

The control method of the present invention uses hardness of the water calculated in the previous operation of the washing machine to set a washing pattern of the present operation of the washing machine in consideration of different characteristics of water by regional groups, thereby having optimum washing and rinsing capacities and minimizing water and energy consumption.

The control method of the present invention displays a variation in the washing pattern to users, thereby improving convenience and utility of the washing machine.

The control method of the present invention calculates hardness of the water, from which a detergent is completely removed in a final rinsing operation of the present operation of the washing machine, thereby being capable of calculating the accurate quantity of the detergent for the next operation of the washing machine, not requiring a separation step for calculating the hardness of the water, and reducing the overall washing time.

The control method of the present invention, in case that the washing machine is operated plural times, calculates and stores the cumulative mean of the hardnesses of water in the plural operations of the washing machine, thereby reducing the variation of the hardness of the water and obtaining more stable and accurate measurement of the hardness of the water.

Further, the control method of the present invention, in case that the washing machine is operated four times or more, calculates and stores the cumulative mean of the hardnesses of water in the plural operations of the washing machine except for the maximum and minimum hardnesses of water so that the hardness abnormally higher or lower than the general hardness is excluded, thereby obtaining accurate measurement of the hardness of the water.

Moreover, the control method of the present invention, in case that the washing machine is operated times corresponding to a predetermined frequency or more, calculates and stores the running mean of the hardnesses of water in the plural operations of the washing machine so that the recent hardnesses of water while excluding the previous hardnesses of water a few months ago are considered, thereby obtaining accurate measurement of the hardness of the water.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Now, preferred embodiments of the present invention will be described in detail with reference to the annexed drawings.

Figure 1:
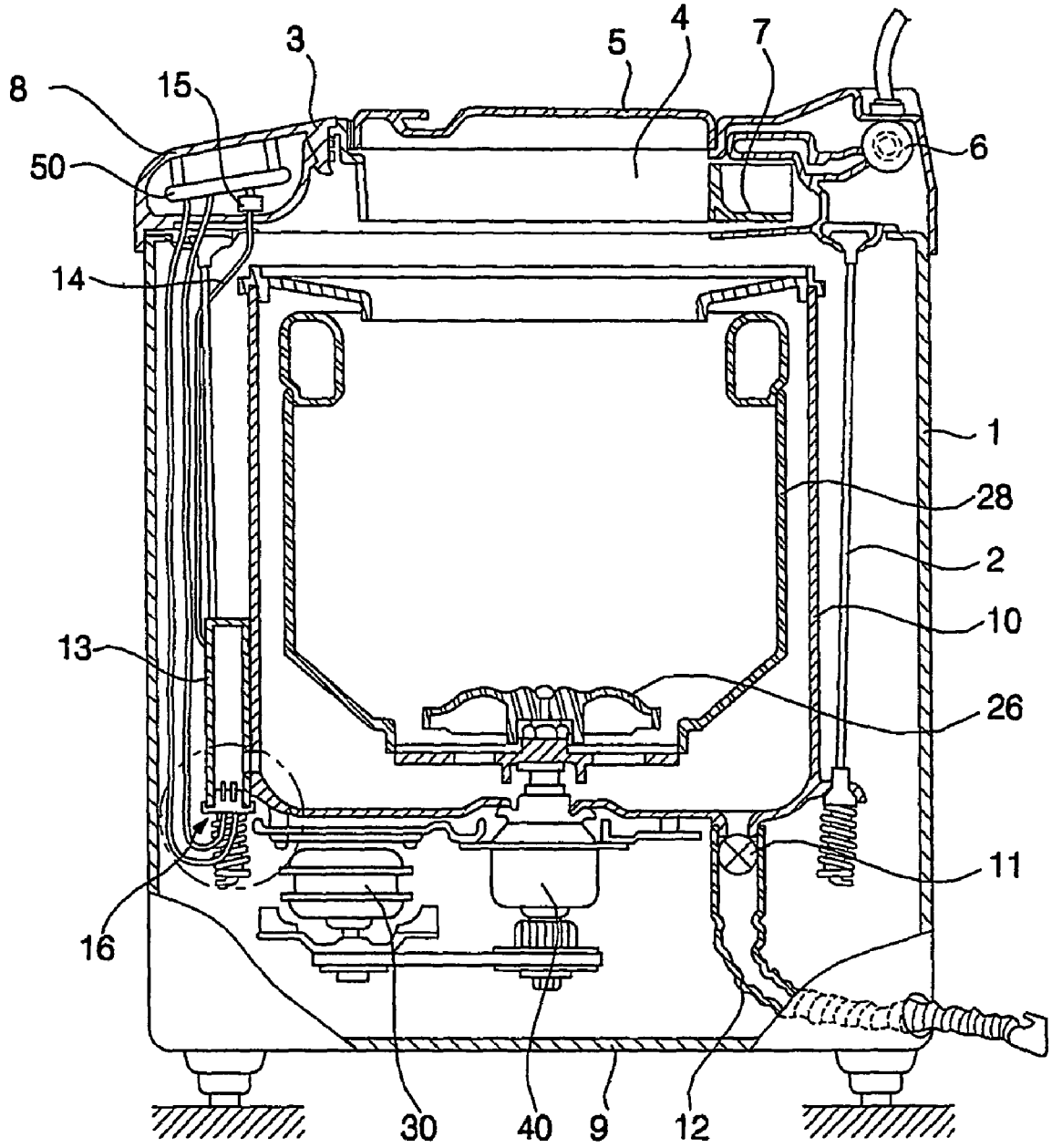
FIG. 1 is a longitudinal-sectional view of a washing machine for performing a control method in accordance with the present invention.
Figure 2:
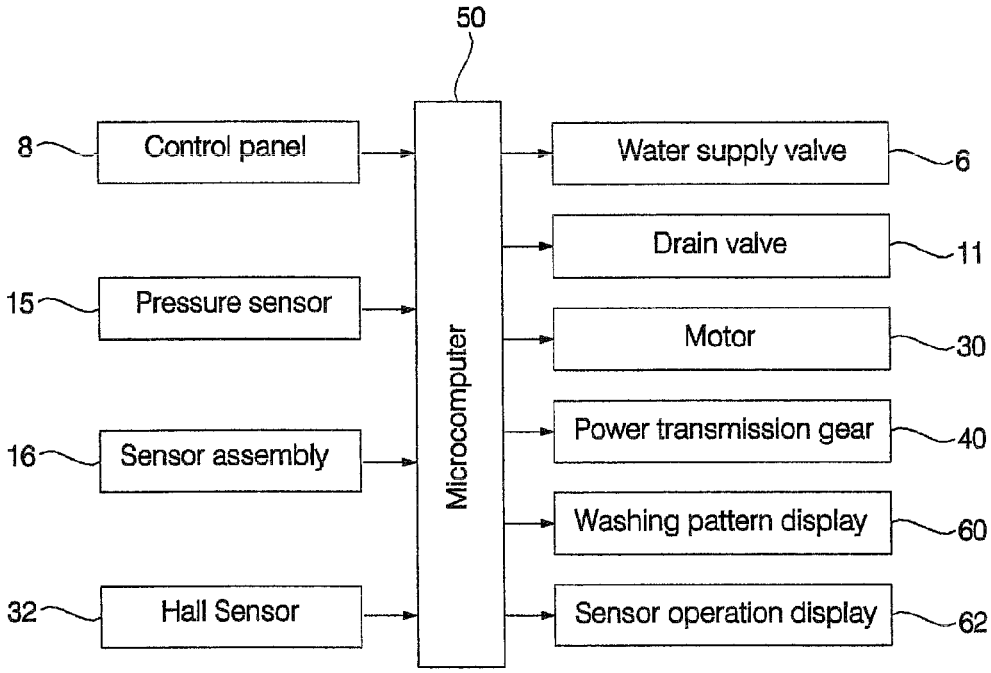
FIG. 2 is a block diagram of the washing machine for performing the control method in accordance with the present invention.

FIG. 1 is a longitudinal-sectional view of a washing machine for performing a control method in accordance with the present invention, and FIG. 2 is a block diagram of the washing machine for performing the control method in accordance with the present invention.

For reference, a washing machine for performing a control method in accordance with the present invention is not limited to an upright-type washing machine as shown in FIG. 1, but may be applied to all kinds of washing machines including drum-type washing machines.

The washing machine shown in FIG. 1 comprises a cabinet 1 defining the external appearance of the washing machine, an outer tub 10 suspended by a supporting member 2 in the cabinet 1 for containing water therein, an inner tub 28 rotatably installed in the outer tub 10 and provided with a wash vane 26 installed on the bottom surface thereof, a motor 30 placed under the outer tub 6 for rotating the wash vane 26 or the inner tub 28, a power transmission gear 40 for transmitting driving force of the motor 30 to the wash vane 26 or the inner tub 28, and a microcomputer 50 for controlling the operation of the washing machine.

A top cover 3 constituting the upper part of the washing machine is placed on the upper end of the cabinet 1.

An opening 4 for putting and taking clothes into and out of the washing machine therethrough is formed through the central portion of the top cover 3, and a lid 5 for opening and closing the opening 4 is rotatably connected to one side of the top cover 3.

A water supply valve 6, for intermitting water supplied through an external hose, and a detergent box 7, for containing a detergent so that the water having passed through the water supply valve 6 is mixed with the detergent and the obtained mixture is supplied to the inner tub 28 or the outer tub 20, are installed on the rear part of the top cover 3.

The microcomputer 50 is installed in the front part of the top cover 3, and a control panel 8 for allowing a user to manipulate the washing machine therethrough is placed on the front part of the top cover 3.

Legs, which are protruded from the lower surface of the cabinet 1, are mounted on a, base 9 supporting the cabinet 1.

A drain valve 11 for intermitting water discharge is installed on the lower part of the outer tub 10, and a drain hose 12 for guiding the water having passed through the drain valve to the outside of the washing machine is connected to the drain valve 11.

An air chamber 13 communicating with the outer tub 10 is installed at one side of the outer tub 10.

An air tube 14 for compressing air, when the water is supplied to the air chamber 13, is connected to the upper part of the air chamber 13, and a pressure sensor 15 for sensing the pressure in the air tube 14 is connected to the air tube 14.

The pressure sensor 15 outputs a signal to the microcomputer 50, and the microcomputer 50 senses a water level based on the signal outputted from the pressure sensor 15.

A sensor assembly 16 for sensing temperature and conductivity of water is installed on the lower end of the air chamber 13.

The sensor assembly 16 senses conductivity and temperature of water, in which the detergent is not dissolved, or conductivity and temperature of water, in which the detergent is dissolved, and thus outputs a corresponding signal to the microcomputer 50. Then, the microcomputer 50 sets a washing pattern, including washing intensity, supplied water level, washing time, rinsing frequency, rinsing time, dehydrating time, etc., based on the signal outputted from the sensor assembly 16.

Here, the washing intensity is adjusted by varying the rotational speed (rpm) of the wash vane 26 or the inner tub 28 or by rotating the wash vane 26 or the inner tub 28.

The motor 30 includes a stator fixed to the lower surface of the outer tub 10, a rotor rotated by the magnetic action with the stator, and a hall sensor 32 for sensing the rotational speed (rpm) or rotational angle of the rotor.

The hall sensor 32 outputs a signal to the microcomputer 50, and the microcomputer 50 senses the quantity of clothes based on the signal outputted from the hall sensor 32.

The microcomputer 50 stores a plurality of tables for determining the quantity of the detergent corresponding to the hardness of the water. Thus, the microcomputer 50 selects one out of the stored tables based on the hardness of the water, and then determines the quantity of the detergent from the conductivity and temperature of the water, in which the detergent is dissolved.

In FIG. 2, reference numeral 60 denotes a washing pattern display, such as an LCD or an LED, for displaying the washing pattern of the washing machine to the outside.

Further, reference numeral 62 denotes a sensor operation display, such as an LCD or an LED, for displaying the sensing operation of the sensor assembly 16 to the outside.

Figure 3:
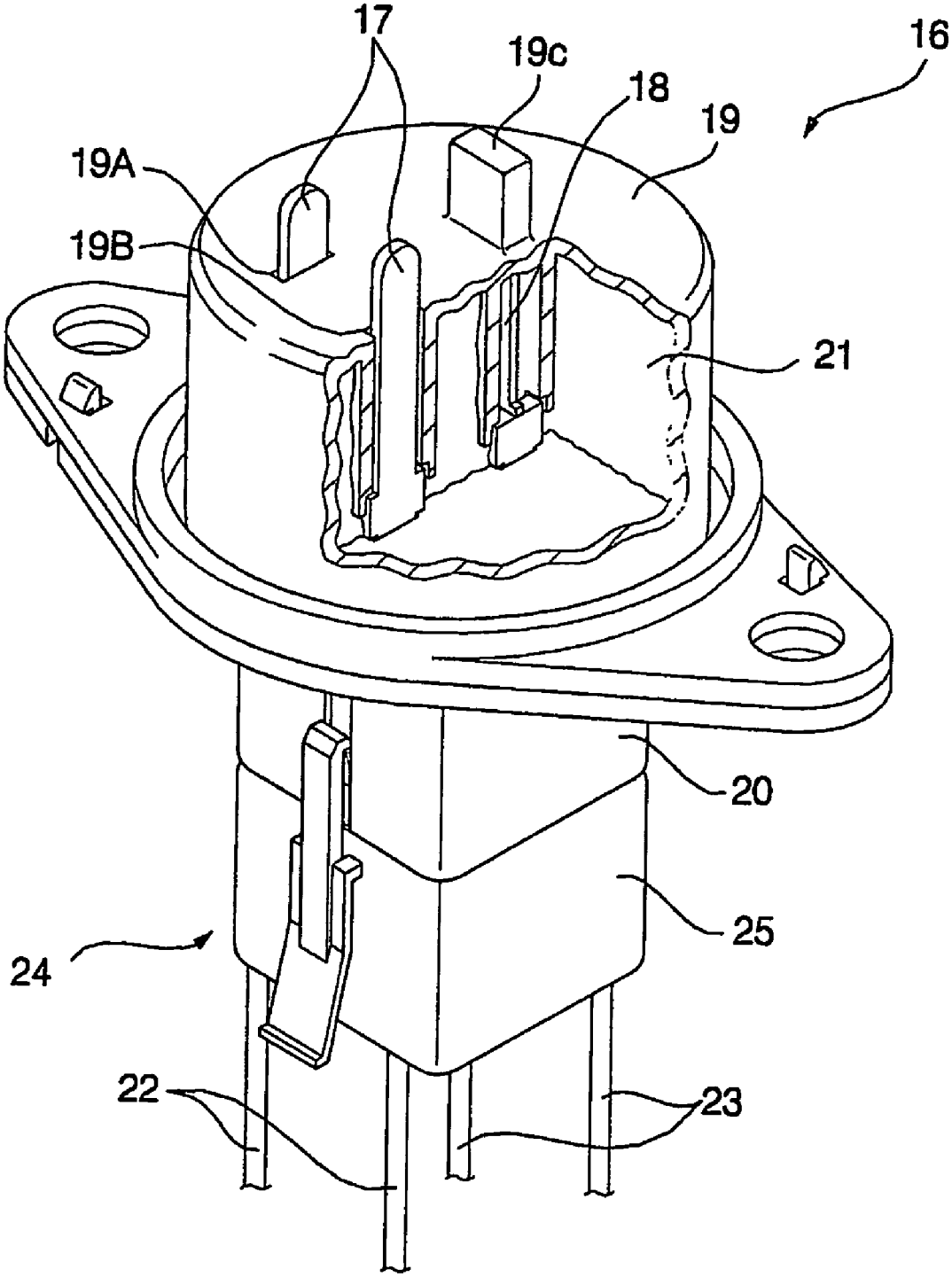
FIG. 3 is a partially-exploded perspective view of a sensor assembly of the washing machine of FIG. 1.
Figure 4:
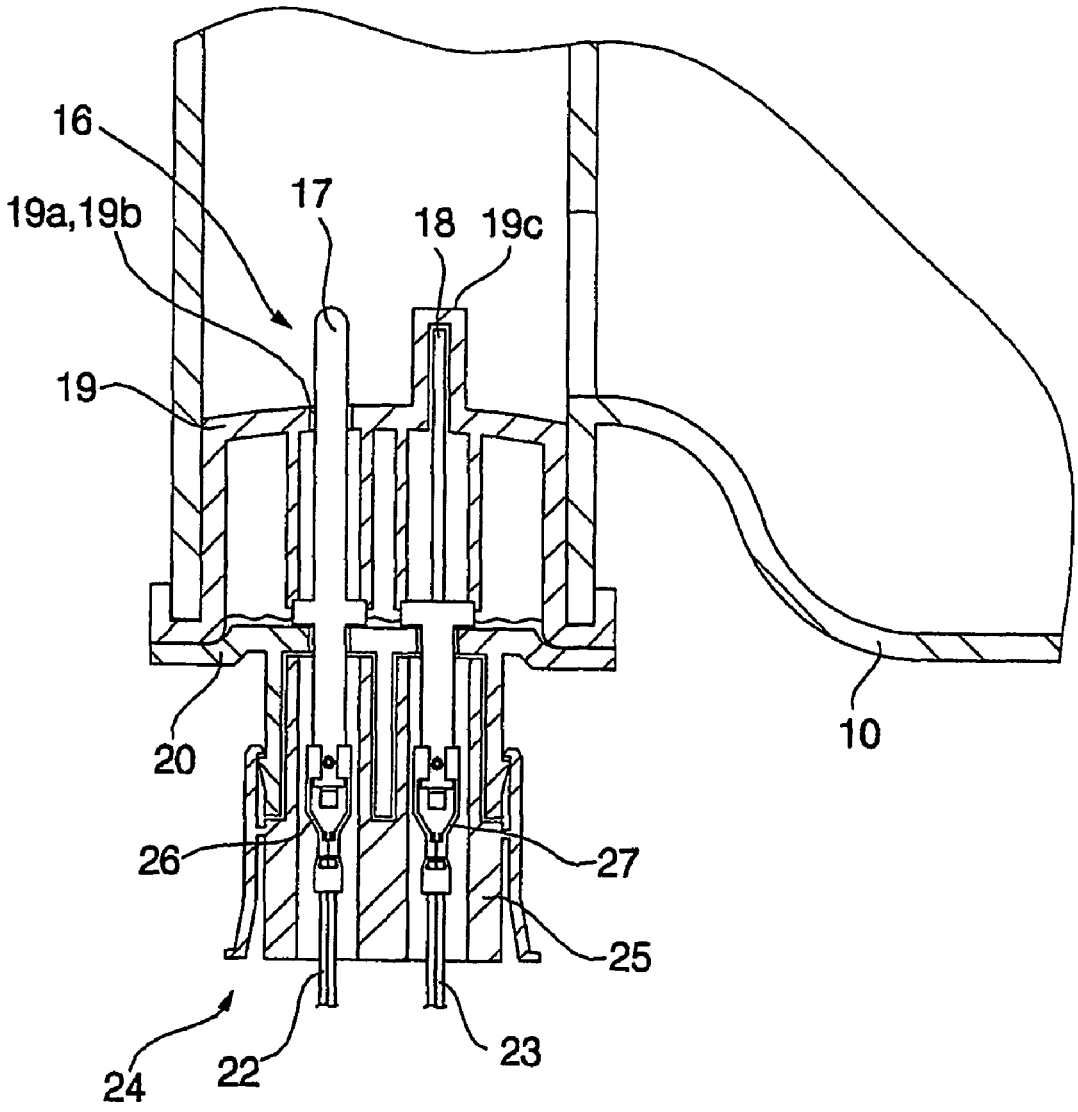
FIG. 4 is an enlarged cross-sectional view of the sensor assembly of the washing machine of FIG. 1.

FIG. 3 is a partially-exploded perspective view of the sensor assembly 16 shown in FIG. 1, and FIG. 4 is an enlarged cross-sectional view of the sensor assembly 16 shown in FIG. 1.

As shown in FIGS. 3 and 4, the sensor assembly 16 includes a conductivity sensor 17 having a pair of conductivity electrodes separated from each other, a temperature sensor 18 having a temperature electrode for sensing a temperature, a housing 19 inserted into the air chamber 13, provided with an opened lower surface, and having a pair of through holes 19A and 19B passing the conductivity electrodes formed on the upper surface thereof and a protrusion 19C surrounding the temperature electrode, a cover 20 passing lower portions of the conductivity electrodes and the temperature electrode and attached to the lower surface of the housing 19, and a filling material 21 filling a space formed between the housing 19 and the cover 20.

A connector 24 may be provided with a plurality of electric wires 22 and 23 and may be attached to the cover 20 such that the sensor assembly 16 and the microcomputer 50 may communicate signals between each other.

The connector 24 may includes a receptacle housing 25 removably attached to the cover 20, and a plurality of receptacles 26 and 27 provided with one of the ends connected to the electric wires 22 and 23 and the other ends removably attached to the conductivity electrodes and the temperature electrode.

Figure 5A:
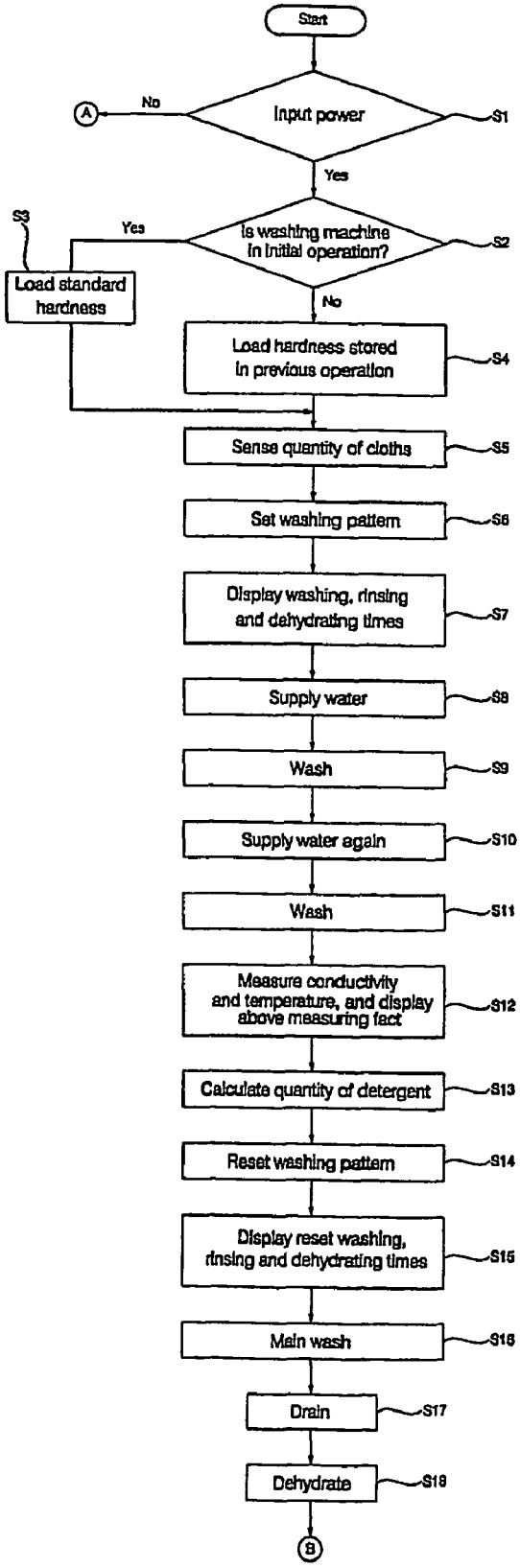
FIGS. 5*a* and 5*b* are flow charts illustrating a control method of a washing machine in accordance with a first embodiment of the present invention.
Figure 5B:
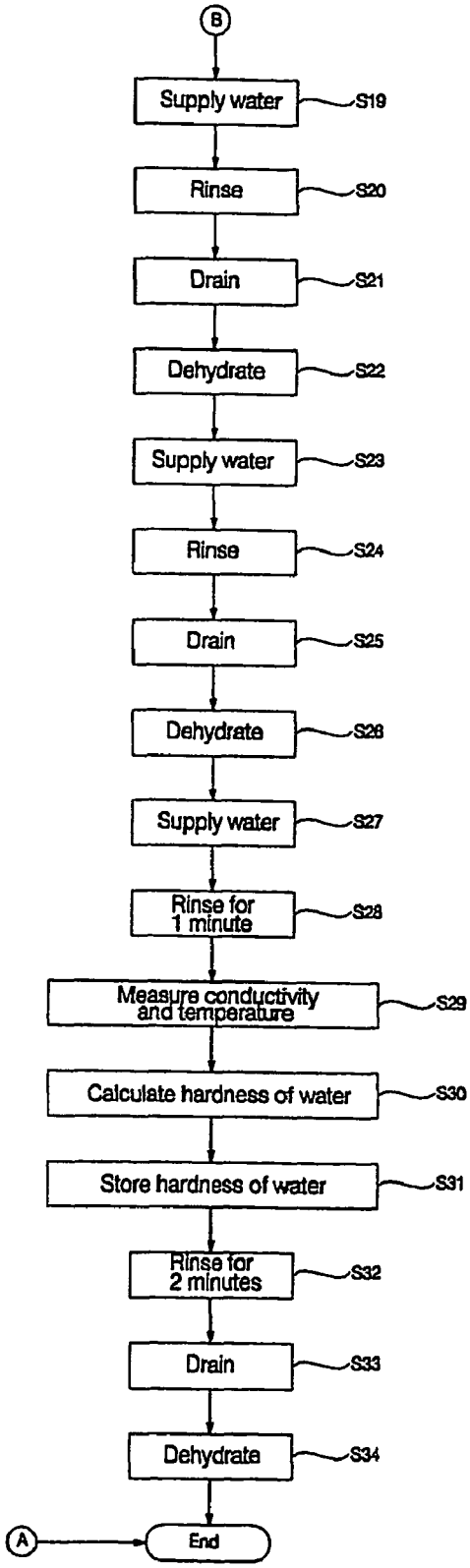

FIGS. 5*a* and 5*b* are flow charts illustrating a control method of a washing machine in accordance with a first embodiment of the present invention;

As shown in FIG. 5*a*, in the control method of the washing machine in accordance with the first embodiment of the present invention, when power and instructions for operating the washing machine are inputted to the washing machine through the control panel 8, the microcomputer 50 determines whether or not the washing machine is in an initial operation (S1 and S2).

In case that it is determined that the washing machine is in the initial operation, the microcomputer 50 loads a standard hardness, which was inputted to the microcomputer 50 in advance. On the other hand, in case that it is determined that the washing machine is not in the initial operation, the microcomputer 50 loads the hardness of the water stored in the previous operation (S3 and S4).

Thereafter, the microcomputer 50 senses the quantity of clothes placed in the washing machine (S5).

Here, the microcomputer 50 rotates the motor 30 so that a pulsator or the inner tub 28 is agitated in a short period of time or rotated once, and measures time, taken to agitate the pulsator or the inner tub 28 or to rotate the pulsator or the inner tub 28 once, or surplus rotating angle from a signal outputted from the hall sensor 32, thereby being capable of sensing the quantity of clothes. Other sensing methods except for the above-described sensing method may be applied to the present invention.

The microcomputer 50 sets a washing pattern based on the sensed quantity of clothes (S6).

Here, preferably, the washing pattern includes all factors regarding the operation of the washing machine, such as washing intensity, supplied water level, washing time, rinsing frequency, rinsing time, dehydrating time, etc. Hereinafter, for convenience of description, the washing pattern is limited to washing intensity, supplied water level, washing time, rinsing frequency, rinsing time, and dehydrating time.

After the microcomputer 50 sets the washing pattern, the microcomputer 50 outputs a control signal to the washing pattern display 60 so that all the factors or only the washing, rinsing and dehydrating times of the set washing pattern are displayed by the washing pattern display 60 to the outside (S7).

The microcomputer 50 turns on the water supply valve 6 so that water is supplied to a first water level of the set washing pattern (S8).

When the water supply valve 6 is turned on, the water passes through the detergent box 7, the detergent contained in the detergent box 7 is dissolved in the water, and the obtained mixture is supplied to the inner tub 28 or the outer tub 10. When the mixture of the water and the detergent is supplied to the first water level, the microcomputer 50 turns off the water supply valve 6.

The microcomputer 50 operates the motor 30 during a first washing time of the set washing pattern.

A rotary current is generated in the inner tub 28, thereby performing a washing operation (S9).

Thereafter, after the first washing time has elapsed, the microcomputer 50 turns on the water supply valve 6 so that water is supplied to a second water level of the set washing pattern (S10).

When the water supply valve 6 is turned on, new water is supplied to the inner tub 28 or the outer tub 10 so that the inner tub 28 or the outer tub 10 contains a larger quantity of water. When the water is supplied to the second water level, the microcomputer 50 turns off the water supply valve 6.

Thereafter, the microcomputer 50 operates the motor 30 during a second washing time of the set washing pattern.

Here, the microcomputer 50 rotates the motor 30 in regular and opposite directions so that the clothes contained in the inner tub 28 are agitated to improve solubility of the detergent in the water (S11).

After the second washing time has elapsed, the microcomputer 50 selects one table out of a plurality of tables storing the quantity of the detergent corresponding to the loaded hardness of the water, outputs a signal to the conductivity sensor 17 and the temperature sensor 18 so that the conductivity sensor 17 and the temperature sensor 18 measure the conductivity and the temperature of the water containing the detergent dissolved therein, and during the measurement, switches on or off the sensor operation display 62 (S12).

The microcomputer 50 calculates the quantity of the detergent using the selected table based on the measured conductivity and temperature of the water containing the detergent dissolved therein (S13).

Then, the microcomputer 50 resets the washing pattern based on the calculated quantity of the detergent (S14).

Here, the microcomputer 50 may reset all or several factors of the washing pattern, which were initially set.

The microcomputer 50 outputs a control signal to the washing pattern display 60 so that all the factors or only the residual washing, rinsing and dehydrating times of the reset washing pattern are displayed by the washing pattern display 60 to the outside (S15).

The microcomputer 50 operates the motor 30 during a third washing time of the reset washing pattern, and, after the third washing time has elapsed, stops the operation of the motor 30, thereby completing the washing operation (S16).

Thereafter, the microcomputer 50 turns on the drain valve 11 to discharge water contaminated during the washing operation to the outside of the washing machine, and, after the discharge of the contaminated water is completed turns off the drain valve 11 (S17).

Then, the microcomputer 50 operates the motor 30 and the power transmission gear 40 in a dehydration mode, thereby dehydrating the clothes in the washing machine (S18).

As shown in FIG. 5*b*, the microcomputer 50 repeats water supply, rinse, drain and dehydration times corresponding to a rinsing frequency of the reset washing pattern.

Here, for convenience of description, the rinsing frequency is reset to three times.

The microcomputer 50 turns on the water supply valve 6 so that water is supplied to a third water level of the reset washing pattern (S19).

When the water supply valve 6 is turned on, the water passes through the detergent box 7, the detergent contained in the detergent box 7 is dissolved in the water, and the obtained mixture is supplied to the inner tub 28 or the outer tub 10. When the mixture of the water and the detergent is supplied to the third water level, the microcomputer 50 turns off the water supply valve 6.

The microcomputer 50 operates the motor 30 during a first rinsing time of the reset washing pattern.

A rotary current is generated in the inner tub 28, thereby performing a rinsing operation (S20).

Thereafter, after the first rinsing time has elapsed, the microcomputer 50 turns on the drain valve 11 so that water contaminated during the rising operation is discharged to the outside of the washing machine, and, after the discharge of the contaminated water is completed, turns off the drain valve 11 (S21).

Then, the microcomputer 50 operates the motor 30 and the power transmission gear 40 in the dehydration mode, thereby dehydrating the clothes in the washing machine (S22).

Thereafter, the microcomputer 50 turns on the water supply valve 6 so that water is supplied to a fourth water level of the reset washing pattern (S23).

When the water supply valve 6 is turned on, the water passes through the detergent box 7, the detergent contained in the detergent box 7 is dissolved in the water, and the obtained mixture is supplied to the inner tub 28 or the outer tub 10. When the mixture of the water and the detergent is supplied to the fourth water level, the microcomputer 50 turns off the water supply valve 6.

The microcomputer 50 operates the motor 30 during a second rinsing time of the reset washing pattern.

A rotary current is generated in the inner tub 28, thereby performing the rinsing operation (S24).

Thereafter, after the second rinsing time has elapsed, the microcomputer 50 turns on the drain valve 11 so that water contaminated during the rising operation is discharged to the outside of the washing machine, and, after the discharge of the contaminated water is completed, turns off the drain valve 11 (S25).

Then, the microcomputer 50 operates the motor 30 and the power transmission gear 40 in the dehydration mode, thereby dehydrating the clothes in the washing machine (S26).

Thereafter, the microcomputer 50 turns on the water supply valve 6 so that water is supplied to a fifth water level of the reset washing pattern (S27).

When the water supply valve 6 is turned on, the water passes through the detergent box 7, the detergent contained in the detergent box 7 is dissolved in the water, and the obtained mixture is supplied to the inner tub 28 or the outer tub 10. When the mixture of the water and the detergent is supplied to the fifth water level, the microcomputer 50 turns off the water supply valve 6.

The microcomputer 50 operates the motor 30 during a third rinsing time of the reset washing pattern.

The microcomputer 50 is rotatably agitated for a designated time (for example, 1 minute) of the third rinsing time (for example, 3 minutes) so that accuracy in calculating the hardness of the water, which will be described later, is improved.

After the designated time (for example, 1 minute) of the third rinsing time (for example, 3 minutes) has elapsed, the microcomputer 50 outputs a signal to the conductivity sensor 17 and the temperature sensor 18 so that the conductivity sensor 17 and the temperature sensor 18 measure the conductivity and the temperature of the water (S28 and S29).

The microcomputer 50 calculates the hardness of the water using a designated equation or a table for determining the hardness of the water based on the measured conductivity and temperature of the water (S30).

The microcomputer 50 stores the calculated hardness of water in an electrically erasable and programmable ROM (EEPROM) (S31).

Then, the microcomputer 50 continuously operates the motor 30 for the residual time (for example, 2 minutes) of the third rinsing time (for example, 3 minutes), and a rotary current is generated in the inner tub 28, thereby performing the rinsing operation (S32).

After the third rinsing time has elapsed, the microcomputer 50 turns on the drain valve 11 so that water contaminated during the rising operation is discharged to the outside of the washing machine, and, after the discharge of the contaminated water is completed, turns off the drain valve 11 (S33).

Then, the microcomputer 50 operates the motor 30 and the power transmission gear 40 in the dehydration mode, thereby dehydrating the clothes in the washing machine (S34).

Figure 6A:
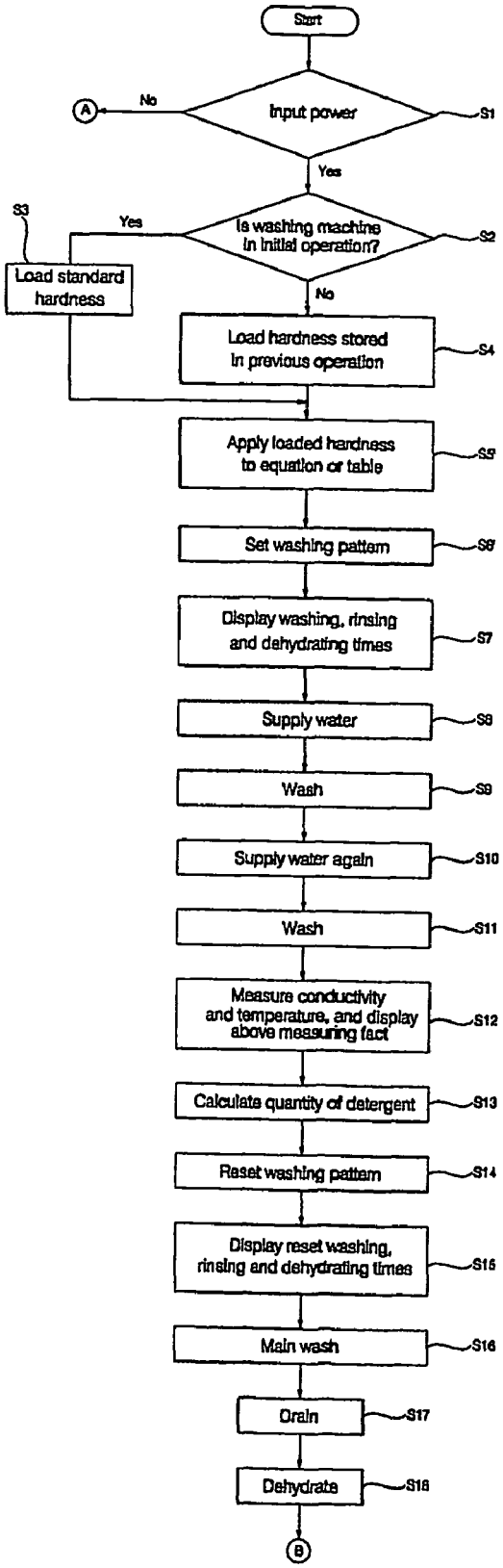
FIGS. 6*a* and 6*b* are flow charts illustrating a control method of a washing machine in accordance with a second embodiment of the present invention.
Figure 6B:
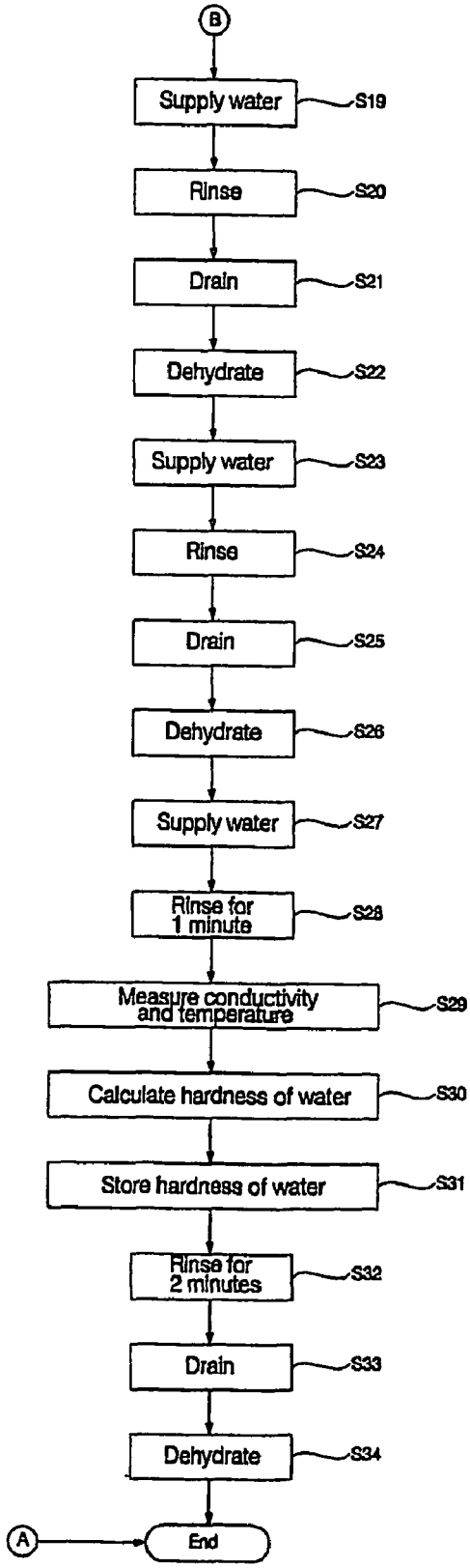

FIGS. 6*a* and 6*b* are flow charts illustrating a control method of a washing machine in accordance with a second embodiment of the present invention.

The control method of the washing machine in accordance with the second embodiment as shown in FIGS. 6*a* and 6*b* differs from the control method of the washing machine in accordance with the first embodiment in that the initial washing pattern is not set based on the quantity of clothes contained in the washing machine. That is, the hardness of the water, which was calculated in the previous operation and stored, is applied to a designated equation or a separate table (S5'), and thus an initial washing pattern is set (S6'). Other steps except for the step of setting the initial washing pattern are substantially the same as those of the first embodiment and are thus denoted by the same reference numerals, and detailed descriptions thereof will be omitted because they are considered to be unnecessary.

That is, in case that hardness of the water, which was calculated in the previous operation and stored, is comparatively high, at least one factor out of washing pattern, such as washing intensity, supplied water level, washing time, rinsing frequency, rinsing time, and dehydrating time, is set to high, and in case that hardness of the water, which was calculated in the previous operation and stored, is comparatively low, at least one factor out of washing pattern, such as washing intensity, supplied water level, washing time, rinsing frequency, rinsing time, and dehydrating time, is set to low. Further, the washing pattern is reset based on the quantity of the detergent, which was measured during the washing operation, and the washing machine is operated according to the reset washing pattern.

The above-described control method of the washing machine in accordance with the second embodiment of the present invention does not require a step for sensing the quantity of clothes, thus reducing energy necessary to sense the quantity of clothes and shortening an overall washing time.

Figure 7A:
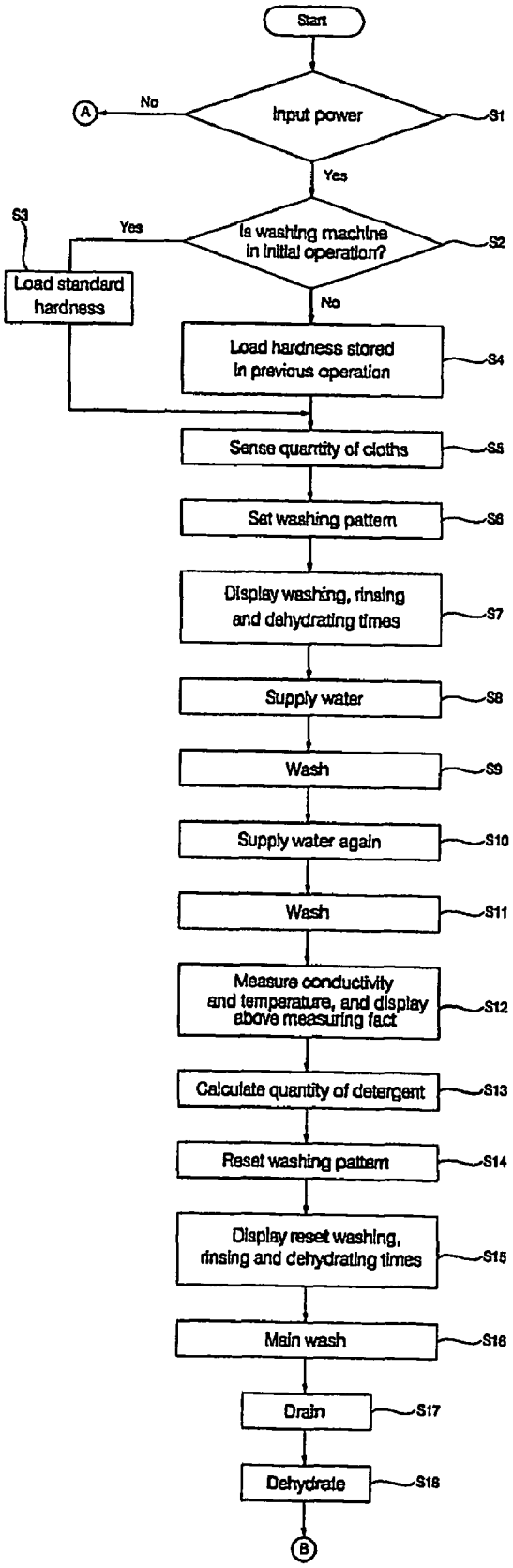
FIGS. 7*a* and 7*b* are flow charts illustrating a control method of a washing machine in accordance with a third embodiment of the present invention.
Figure 7B:
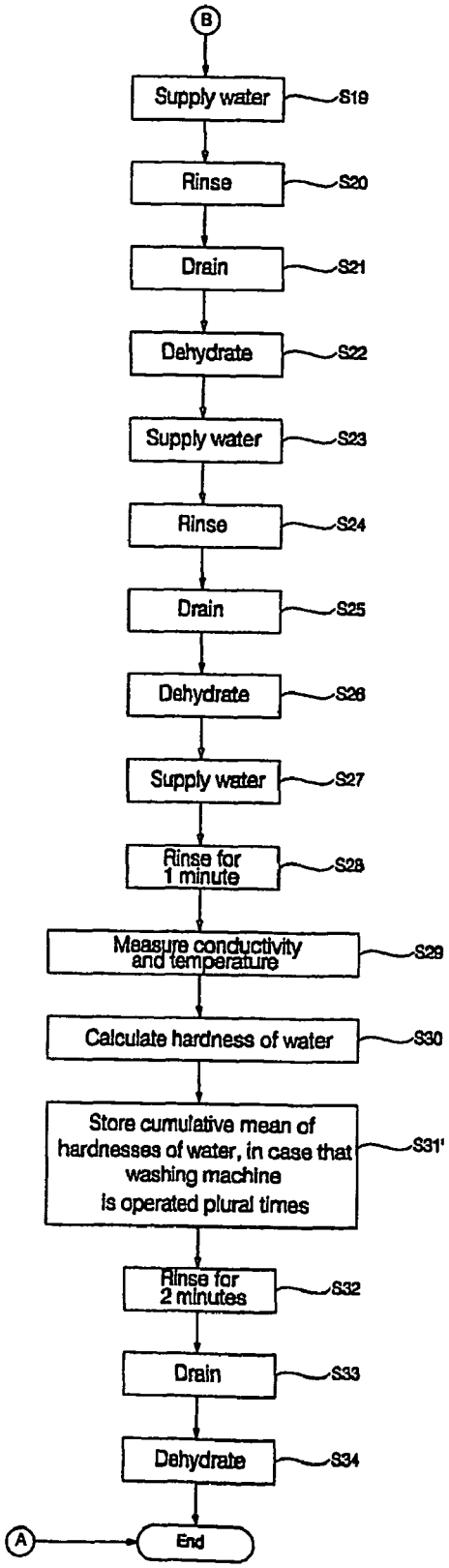

FIGS. 7*a* and 7*b* are flow charts illustrating a control method of a washing machine in accordance with a third embodiment of the present invention.

In the control method of the washing machine in accordance with the third embodiment as shown in FIGS. 7*a* and 7*b*, in case that the washing machine has been operated plural times, the cumulative mean of hardnesses of water calculated in operations of the washing machine is calculated, and the calculated cumulative mean is stored for the next operation of the washing machine (S31'). Other steps except for the step of calculating the cumulative mean are substantially the same as those of the first embodiment and are thus denoted by the same reference numerals, and detailed descriptions thereof will be omitted because they are considered to be unnecessary.

That is, as shown in Equation 1 below, the cumulative mean of the hardnesses of water is calculated by adding the hardnesses of water, which were calculated in the previous operations and stored, and the hardness of the water, which is calculated in the present operation, and by dividing the added value by the total operating frequencies (N) of the washing machine.

$$CumulativeMean = \frac{(H1 + H2 + H3 + H4 + H5)}{N} \qquad \text{[Equation 1]}$$

As described above, the control method of the washing machine in accordance with the third embodiment stores the cumulative mean of the hardnesses of water calculated in plural operations of the washing machine, thus reducing the variation of the hardness of the water and obtaining more accurate measurement of the hardness of the water, compared to the other control methods, which store only the hardness of the water calculated in the previous operation just before the present operation of the washing machine.

Figure 8A:
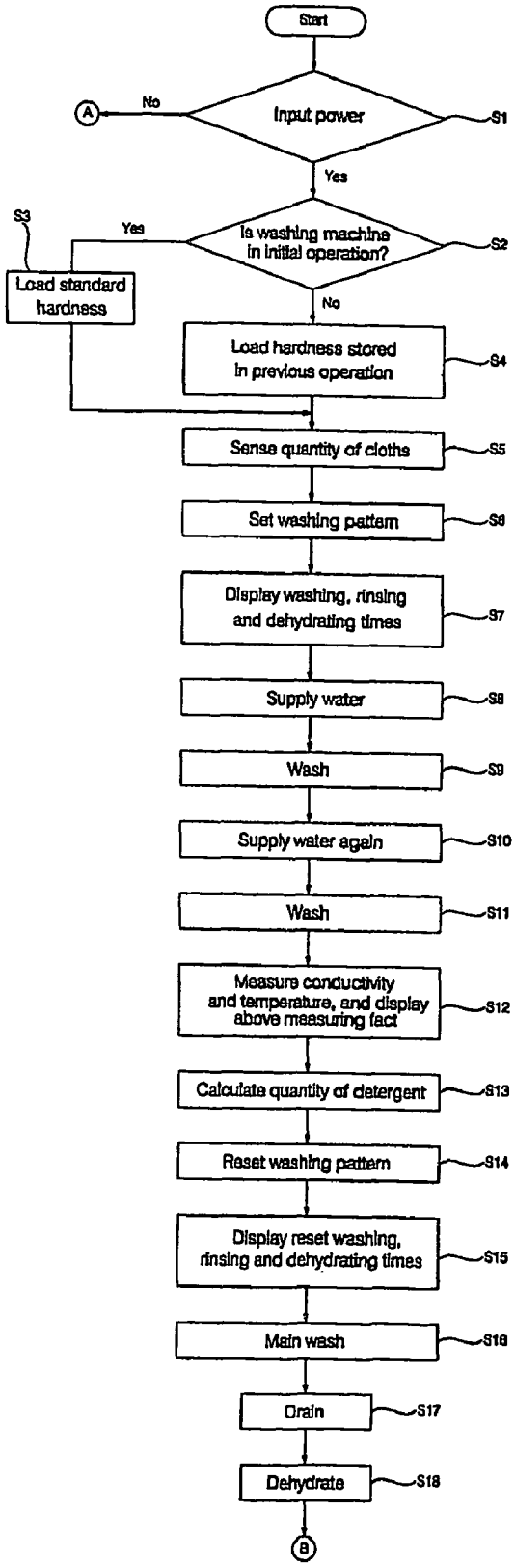
FIGS. 8*a* and 8*b* are flow charts illustrating a control method of a washing machine in accordance with a fourth embodiment of the present invention.
Figure 8B:
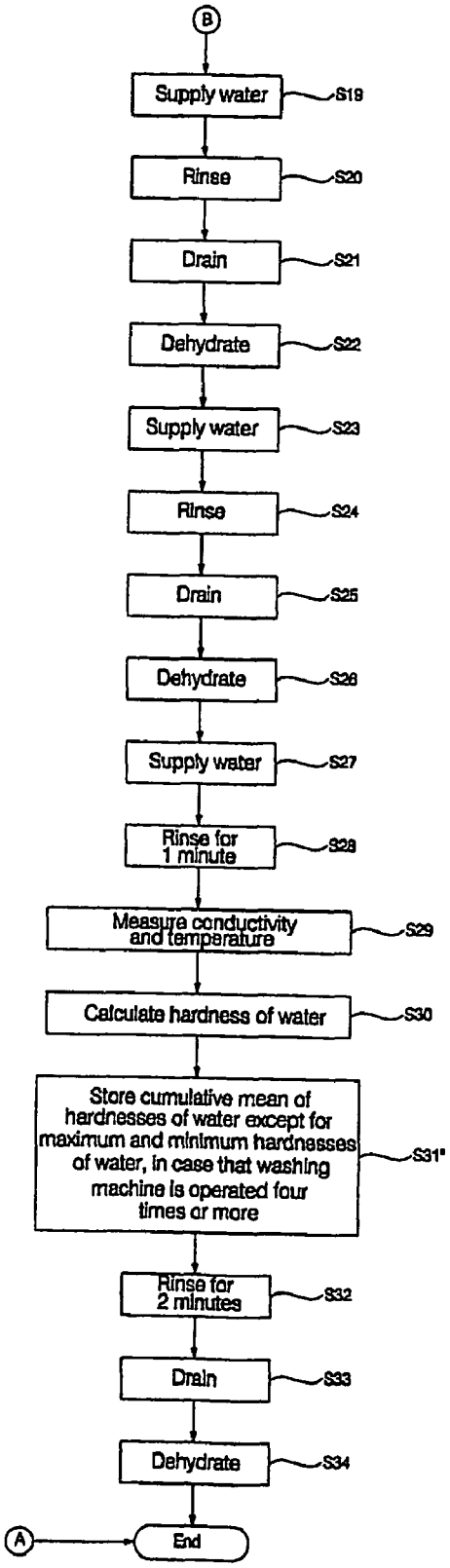

FIGS. 8*a* and 8*b* are flow charts illustrating a control method of a washing machine in accordance with a fourth embodiment of the present invention.

In the control method of the washing machine in accordance with the fourth embodiment as shown in FIGS. 8*a* and 8*b*, in case that the washing machine has been operated plural times, the cumulative mean of hardnesses of water calculated in operations of the washing machine except for the maximum and minimum hardnesses of water is calculated, and the calculated cumulative mean is stored for the next operation of the washing machine (S31"). Other steps except for the step of calculating the cumulative mean of the hardnesses of water except for the maximum and minimum hardnesses are substantially the same as those of the first embodiment and are thus denoted by the same reference numerals, and detailed descriptions thereof will be omitted because they are considered to be unnecessary.

That is, as shown in Equation 2 below, the cumulative mean of the hardnesses of water is calculated by adding the hardnesses of water (H2, H3 and H4), which were calculated in the previous operations and the present operation, except for the maximum hardness (H5) and the minimum hardness (H1) and by dividing the added value (H2+H3+H4) by the value obtained by subtracting 2 from the total operating frequencies (N) of the washing machine.

$$CumulativeMeanExceptforMaximumandMinimumValues = \frac{(H2 + H3 + H4)}{N - 2} \quad \text{[Equation 2]}$$

In case that the operating frequency (N) of the washing machine is less than 4, it is preferable that the simple cumulative mean is calculated in the same manner as the third embodiment of the present invention.

As described above, the control method of the washing machine in accordance with the fourth embodiment excludes the hardness abnormally higher or lower than the general hardness, thereby obtaining accurate measurement of the hardness of the water.

Figure 9A:
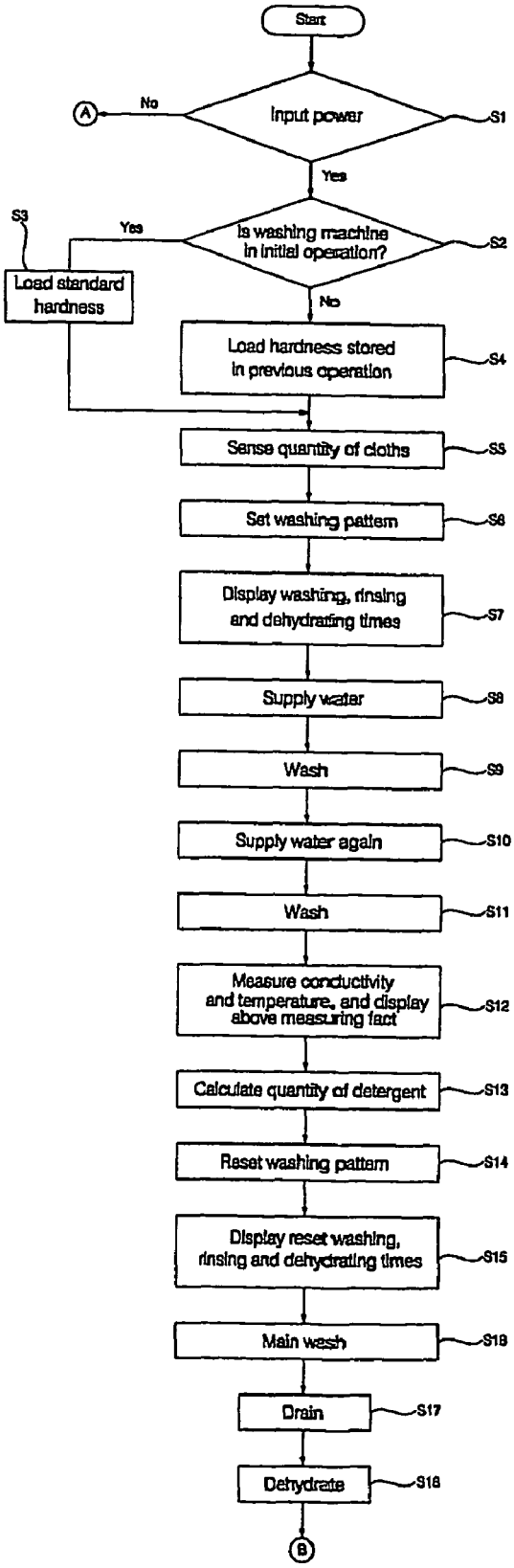
FIGS. 9*a* and 9*b* are flow charts illustrating a control method of a washing machine in accordance with a fifth embodiment of the present invention.
Figure 9B:
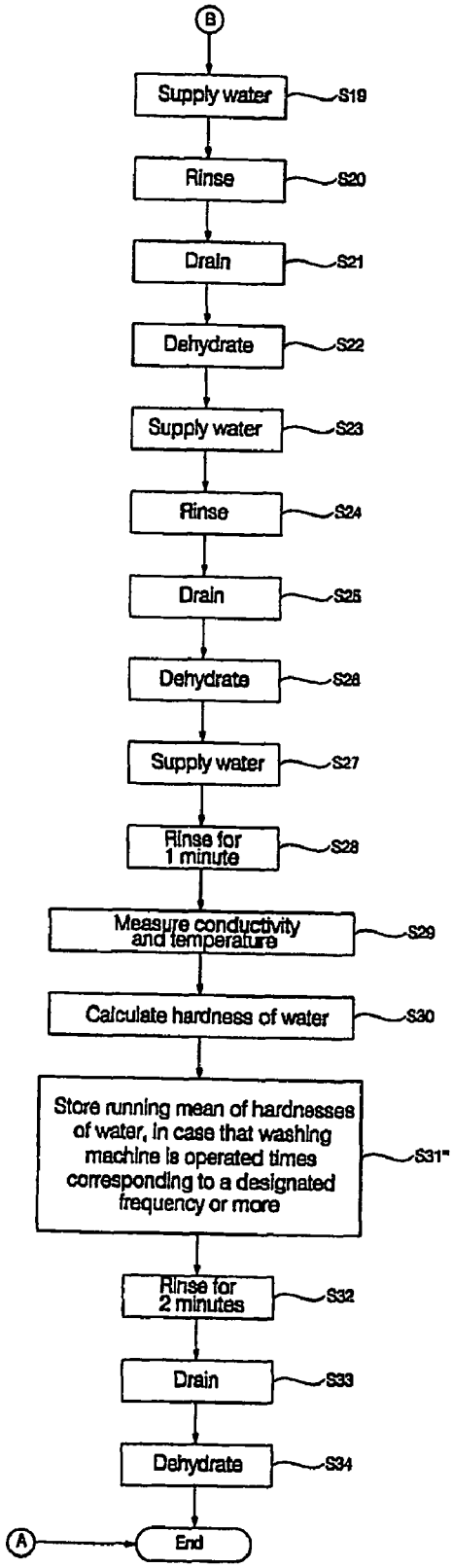

FIGS. 9*a* and 9*b* are flow charts illustrating a control method of a washing machine in accordance with a fifth embodiment of the present invention.

In the control method of the washing machine in accordance with the fifth embodiment as shown in FIGS. 9*a* and 9*b*, in case that the washing machine has been operated plural times, a predetermined frequency (a) is stored in the microcomputer 50, and is compared to the operating frequency (N) of the washing machine. Only in case that the operating frequency (N) of the washing machine is larger than the predetermined frequency (a), the running mean is stored (S31'''). Other steps except for the step of storing the running mean of the hardnesses of water are substantially the same as those of the first embodiment and are thus denoted by the same reference numerals, and detailed descriptions thereof will be omitted because they are considered to be unnecessary.

That is, when the operating frequency (N) of the washing machine reaches the predetermined frequency (a), as shown in Equation 3 below, the running mean of the hardnesses of water is calculated by adding only the recent hardnesses of water (H5, H6, . . . and HN), which correspond to the predetermined frequency and dividing the added value (H5+H6+ . . . +HN) by the predetermined frequency (a).

$$RunningMean = \frac{(H5 + H6 + \ldots + HN)}{a} (N > a) \quad \text{[Equation 3]}$$

Here, the residual hardnesses of water, which are not used to calculate the running mean, are deleted.

On the other hand, in case that the operating frequency (N) of the washing machine is not larger than the predetermined frequency (a), it is preferable that the cumulative mean is calculated and stored in the same manner as the second and third embodiments.

As described above, the control method of the washing machine in accordance with the fifth embodiment does not increase the quantity of data to be processed more than a designated limit, thus eliminating the limit of storage capacity and processing capacity of an EEPROM generated when the cumulative mean is calculated. Further, the control method of the washing machine in accordance with the fifth embodiment considers the recent hardnesses of water while excluding the previous hardnesses of water a few months ago, thus obtaining accurate measurement of the hardness of the water.

INDUSTRIAL APPLICABILITY

As apparent from the above description, the present invention provides a control method of a washing machine, in which hardness of the water calculated in the previous operation of the washing machine is used to set a washing pattern of the present operation of the washing machine in consideration of different characteristics of water by regional groups, thereby having optimum washing and rinsing capacities and minimizing water and energy consumption.

The control method of the present invention displays a variation in the washing pattern to users in real time, thereby providing convenience and utility of the washing machine to the users.

The control method of the present invention calculates hardness of the water, from which a detergent is completely removed, in a final rinsing operation of the present operation of the washing machine, thereby being capable of calculating the accurate quantity of the detergent for the next operation of the washing machine, not requiring a separate step for calculating the hardness of the water, and reducing the overall washing time.

The control method of the present invention, in case that the washing machine is operated plural times, calculates and stores the cumulative mean of the hardnesses of water in the plural operations of the washing machine, thereby reducing the variation of the hardness of the water and obtaining more stable and accurate measurement of the hardness of the water.

Further, the control method of the present invention, in case that the washing machine is operated four times or more, calculates and stores the cumulative mean of the hardnesses of water in the plural operations of the washing machine except for the maximum and minimum hardnesses of water so that the hardness abnormally higher or lower than the general hardness is excluded, thereby obtaining accurate measurement of the hardness of the water.

Moreover, the control method of the present invention, in case that the washing machine is operated times corresponding to a predetermined frequency or more, calculates and stores the running mean of the hardnesses of water in the plural operations of the washing machine so that the recent hardnesses of water while excluding the previous hardnesses of water a few months ago are considered, thereby obtaining accurate measurement of the hardness of the water.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A method of controlling a washing machine, the method comprising:

setting a first washing pattern based on a first hardness of water calculated and stored in a previous operation of the washing machine;

performing a washing operation based on the first washing pattern;

measuring a first temperature and conductivity of water supplied into a tub of the washing machine, after detergent is supplied into the tub;

resetting a second washing pattern based on the measured first temperature and conductivity of water;

continuing the washing operation comprising a main washing step based on the second washing pattern; and calculating and storing a second hardness of water for a next operation of the washing machine.

2. The method as set forth in claim 1, wherein the first hardness of water stored in the previous operation of the washing machine is automatically loaded when power is applied to the washing machine.

3. The method as set forth in claim 1, wherein the second hardness of water is calculated after water in the washing machine is agitated for a predetermined period of time.

4. The method as set forth in claim 1, wherein the calculating and storing the second hardness of water includes:

measuring a second temperature and conductivity of water; and calculating the second hardness of water based on the measured second temperature and conductivity of the water.

5. The method as set forth in claim 4, wherein the measuring the second temperature and conductivity of water is performed a predetermined period of time before a final rinsing operation is completed.

6. The method as set forth in claim 1, wherein the setting the first washing pattern and resetting the second washing pattern each includes setting at least one of a washing intensity, supplied water level, washing time, rinsing frequency, rinsing time, or dehydrating time.

7. The method as set forth in claim 1, wherein the setting the first washing pattern further comprises, if the washing machine is in an initial operation, setting the first washing pattern based on a preloaded standard hardness of water.

8. The method as set forth in claim 1, wherein the calculating and storing the second hardness of water comprises, when the washing machine is operated a plurality of times, calculating and storing a cumulative mean of the hardnesses of water based on the calculated hardness of water from each of the plurality of operations of the washing machine.

9. The method as set forth in claim 1, wherein the calculating and storing the second hardness of water comprises, if the washing machine is operated four times or more, calculating and storing a cumulative mean of the hardnesses of water based on the calculated hardness of water from each of the four or more operations of the washing machine, wherein maximum and minimum hardnesses of water from the four or more of operations of the washing machine are omitted from the calculation of the cumulative mean.

10. The method as set forth in claim 1, wherein the calculating and storing the second harness of water comprises, if the washing machine is operated more than a predetermined frequency of operation, calculating and storing a running mean of the hardnesses of water based on a predetermined number of most recent calculated hardness of water from the plurality of operations of the washing machine.

11. The method as set forth in claim 1, wherein the washing pattern is displayed on a display of the washing machine.

12. A method of controlling a washing machine, the method comprising:

initiating a first wash cycle, wherein the first wash cycle is set to a first washing pattern based on a first water hardness value;

measuring a conductivity and temperature of water having detergent added thereto and adjusting the first washing pattern based on the detected conductivity and temperature during a main wash phase of the first wash cycle;

measuring a second water hardness value during the first wash cycle;

storing the second water hardness value; and initiating a second wash cycle, wherein the second wash cycle is set to a second washing pattern based on the second water hardness value retrieved from the storage device.

13. The method of claim 12, further comprising:

measuring a third water hardness value during the second wash cycle; and storing the third water hardness value.

14. The method of claim 13, wherein the second and third water hardness values are stored on a storage device to be retrieved during a next wash cycle.

15. The method of claim 13, wherein the third water hardness value is measured during a rinse cycle of the second wash cycle.

16. The method of claim 12, wherein the method further comprises:

initiating a plurality of additional wash cycles, and measuring and storing a water hardness value during each of the plurality of wash cycles.

17. The method of claim 16, further comprising:

calculating a cumulative mean of water hardness based on the measured water hardness values from the plurality of wash cycles.

18. The method of claim 17, wherein the calculating the cumulative mean comprises excluding a maximum and a minimum water hardness value in the calculation of the cumulative mean.

19. The method of claim 16, further comprising:

calculating a running mean of water hardness based on the measured water hardness values from the plurality of wash cycles, wherein the running mean includes measured water hardness values from a predetermined number of most recent wash cycles.

20. The method of claim 12, wherein the first or second washing pattern includes varying at least one of a washing intensity, a water level, a wash cycle duration, a rinse frequency, a rinse duration, or a drying duration.

21. The method of claim 20, wherein setting the first or second washing pattern further comprises:

increasing the at least one of the washing intensity, the water level, the wash cycle duration, the rinse frequency, the rinse duration, or the drying duration if the first or second water harness value is above a first predetermined value; and reducing the at least one of the washing intensity, the water level, the wash cycle duration, the rinse frequency, the rinse duration, or the drying duration if the first or second water harness value is below a second predetermined value.

22. The method of claim 12, wherein measuring the second and third water hardness values comprises measuring a conductivity and temperature of the water.

23. A method of controlling a washing machine, the method comprising:

initiating a plurality of wash cycles;

measuring a water hardness value during each of the plurality of wash cycles;

storing each of the measured water hardness values on a storage device;

calculating a cumulative mean of water hardness based on the plurality of measured water hardness values;

setting a washing pattern for a subsequent wash cycle based on the cumulative mean of water hardness, wherein the cumulative mean of the water hardness is updated after each of the subsequent wash cycles; and measuring a conductivity and temperature of water having detergent added thereto during each of the plurality of wash cycles, and adjusting a washing pattern based on the detected conductivity and temperature during a main wash phase of each wash cycle.

24. The method of claim 23, wherein the water hardness is measured during a final rinse cycle at a prescribed time period after initiation of the final rinse cycle of each wash cycle.

25. The method of claim 23, wherein the water hardness is measured during a main wash phase during of each wash cycle.

* * * * *